United States Patent [19]

Grow

[11] 4,385,766

[45] May 31, 1983

[54] MARBLE GAME ACTION TOY

[76] Inventor: Harlow B. Grow, 16530 Chattanooga Pl., Pacific Palisades, Calif. 90272

[21] Appl. No.: 299,712

[22] Filed: Sep. 8, 1981

[51] Int. Cl.[3] ..... A63F 7/00

[52] U.S. Cl. ..... 273/328

[58] Field of Search ..... 273/328, 113, 115

[56] References Cited

U.S. PATENT DOCUMENTS 3,700,241 10/1972 Tracy ..... 273/328

3,743,292 7/1973 Tracy ..... 273/328

3,901,510 8/1975 Demaio ..... 273/113

*Primary Examiner*—William H. Grieb

*Attorney, Agent, or Firm*—William H. Maxwell

[57] ABSTRACT

An action toy for playing competitive marble games requiring skill and development of competitive spirit played against time in collecting marbles in a receiver from which they may be rejected, and embodied in a transparent containment cylinder in which the receiver rotates, and all of which is adapted to be revolved and tilted and moved bodily as a unit to apply force to throw the marbles into the receiver.

3 Claims, 3 Drawing Figures

Figure 1:
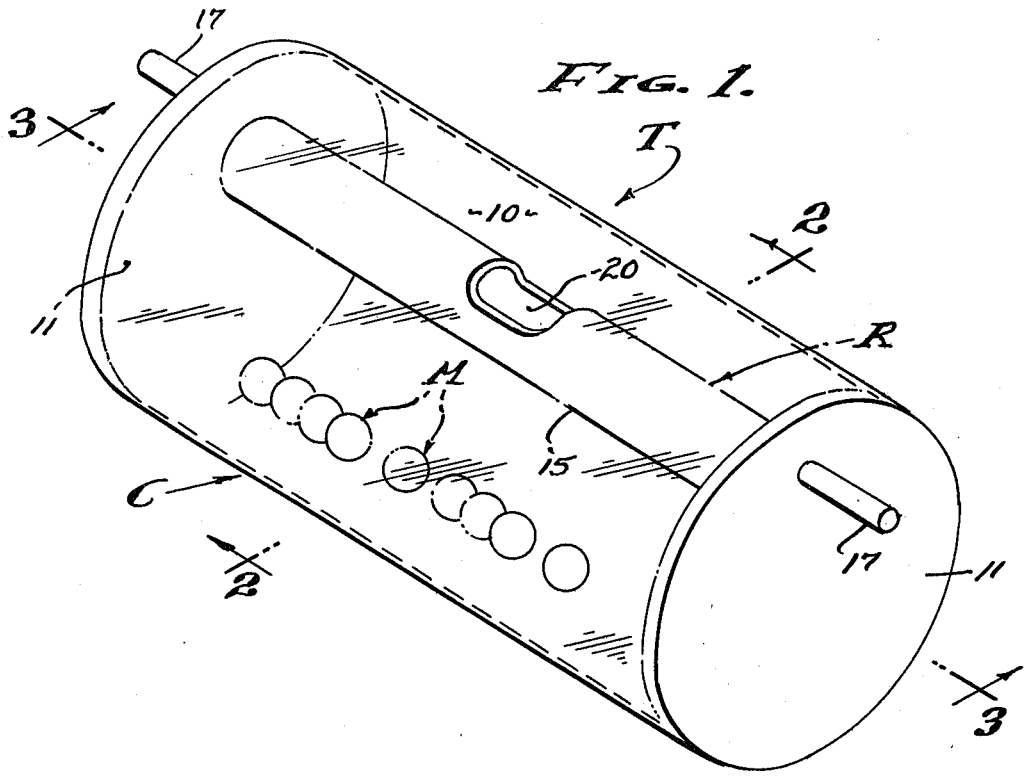

17
3
T
10
2
20
11
R
M
15
C
2
17
11
3

T
20
17
C
R
16
15
10
11
M

MARBLE GAME ACTION TOY

BACKGROUND

This invention relates to the use of marbles in an action toy to be played as a game by both children and adults, in order to develop skill and a competitive spirit. Loose marbles are unsafe when made available to children and when accessible to infants, and accordingly it is a general object of this invention to contain a multiplicity of playing marbles within the confines of the toy device. With the present invention, a number of marbles can be visibly contained and the accomplishments of the game are observed through transparent walls thereof.

The game to be played with this toy involves marbles of two or more distinguishable colors, one color for each player, and/or additionally a control marble of another or third color. The rules of the game can vary, however a basic objective of such a game is for a player to collect one color of marbles, to reject the other color or colors of marbles, and to avoid collecting the control marble. The expertise of the players is balanced against time in order to determine a winner, and it is skillful manipulation of the toy which produces the results. In practice, rotating, tilting and displacement motions are involved, there being relatively rotatable members that are tilted and that are displaced bodily for the application of force to throw the marbles for collection in a receiver. The marbles are contained within a transparent cylinder where they are thrown into and rejected from the receiver. It is preferred that the receiver rotate independently of the containment cylinder, for the rejection of a marble as may be required.

It is an object of this invention to provide a simple and practical action toy for the development of skill and competitive spirit, and a toy which is inherently safe. There are no loose marbles! With the present invention, all marbles are contained within a transparent cylinder, with no access and no openings therefor.

It is also an object of this invention to provide a marble receiver and target within the confines of the aforesaid containment cylinder, whereby skill is required for the collection of marbles, especially marbles of one color, and conversely the rejection by skill of marbles of other colors.

It is still another object of this invention to provide a means by which marbles of said other unwanted color are rejected with skill without loosing the marble of said wanted color. With the present invention the receiver is rotatable so as to dump marbles, dependent upon tilting, and the receiver is preferably rotatable within the containment cylinder to do so. In practice, the receiver is also transparent so as to observe the marbles collected therein.

SUMMARY OF INVENTION

This invention provides an action toy that requires skill for its operation. A multiplicity of marbles is involved, and when there are two players to compete, then there are two color groups of marbles, one group for each player. Additionally, there is one or more and preferably a single control marble of a distinguishable or third color which is a "scratch" marble that voids the players score when collected by the receiver. The receiver is rotatable within the containment cylinder of transparent material, and the ends of which are closed for containment of the marbles and for safety with respect to children and infants.

The foregoing and various other objects and features of this invention will be apparent and fully understood from the following detailed description of the typical preferred form and application thereof, throughout which description reference is made to the accompanying drawings.

FIG. 1 is a perspective view of the action toy of the present invention with the marbles contained and by which games of skill are played.

Figure 2:
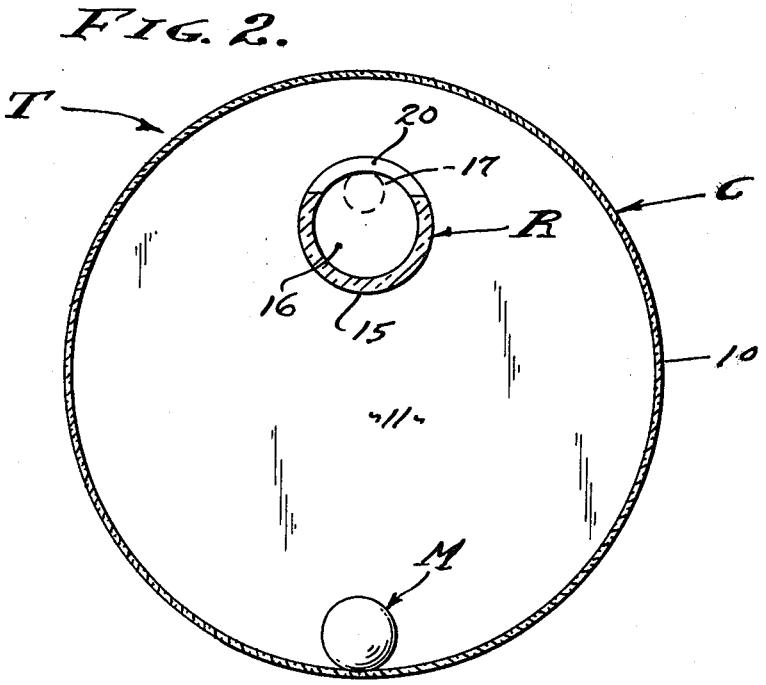
Figure 3:
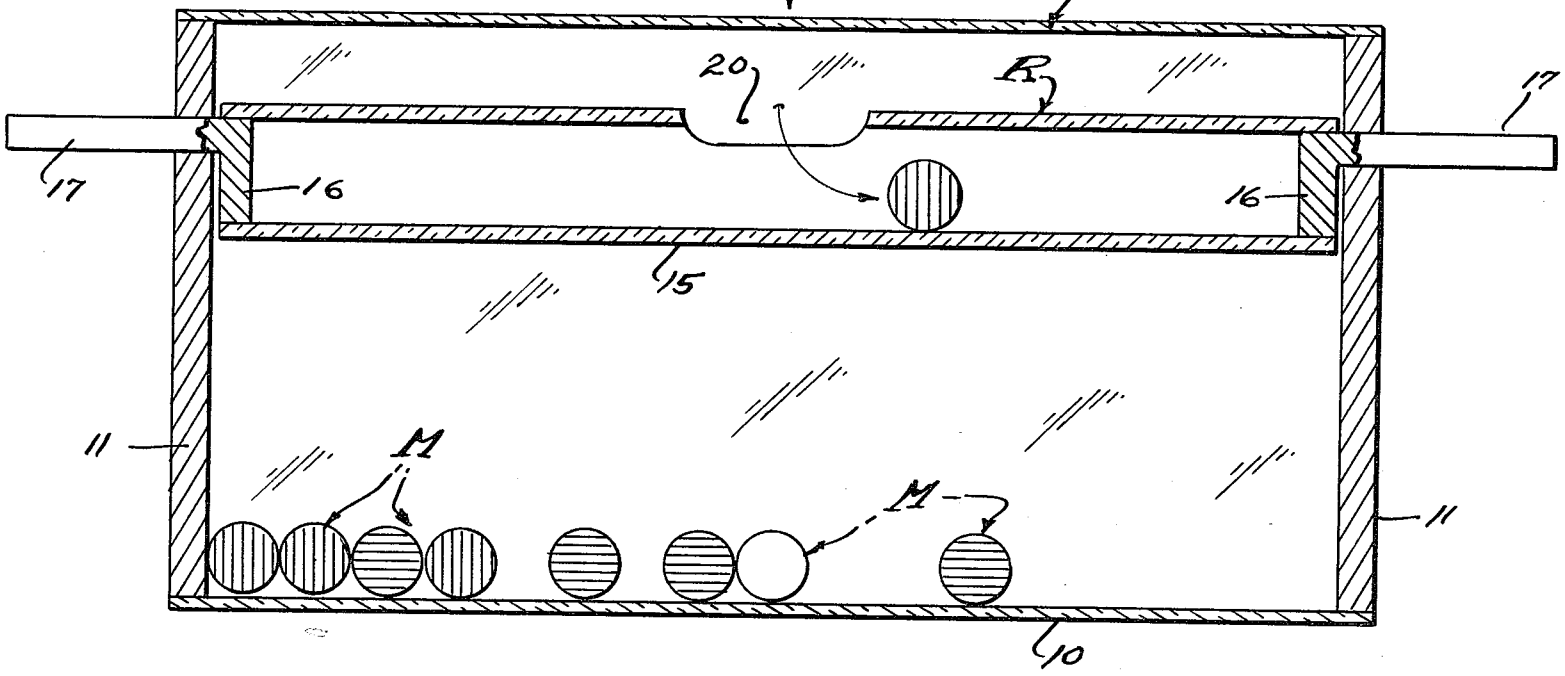

FIGS. 2 and 3 are enlarged sectional views taken as indicated by lines 2—2 and 3—3 on FIG. 1.

PREFERRED EMBODIMENT

Referring now to the drawings, there is an action toy T for playing competitive games involving a multiplicity of marbles. As shown, there are two groups of distinguishably colored marbles M, red and blue, and four in each group. Additionally, there is a single "scratch" marble which is white. Each color group is chosen by and represents a player. In practice, the marbles are $\frac{1}{2}$ inch in diameter and made of glass or the like so as to have substantial mass and inertial qualities.

The action toy T is comprised of two relatively moveable members, a containment cylinder C and a receiver R, fabricated of plastic material so as to be produced economically in large quantity. These members C and R and the separate parts thereof can be injection molded and/or vacuum formed etc., all as circumstances require.

The containment cylinder C is the main body of the device, and is shown of right cylinder form 4 inches in diameter and 8 inches in length. The cylinder wall 10 is transparent throughout, being made of clear thin walled plastic as is indicated. The opposite ends of the containment cylinder C are closed by full diameter end walls 11. A feature is that the walls 10 and 11 are coextensively imperforate, or such that the marbles cannot penetrate the same. Accordingly, the walls 10 and 11 are assembled over the marbles M to be contained therein when initially installing the receiver R as next described.

The receiver R is a chambered member of tubular cross section that is rotatable within the containment cylinder C and which presents a target for the skillfull collection of the select marbles. As shown, the receiver R is a rigid tubular member substantially smaller in diameter than the containment cylinder C; for example $\frac{3}{4}$ inch in outside diameter and with an inside diameter greater than the marble diameters, but substantially less than two marble diameters. The receiver R is disposed to extend longitudinally coextensive within the containment cylinder parallel to the axis thereof and near to one side thereof, spaced therefrom no nearer than one marble diameter. The receiver R has a cylinder wall 15 of clear rigid plastic material, and its opposite ends are closed by end walls 16 from which coaxial trunnions 17 extend through bearing openings 18 in the end walls 11 of the containment cylinder. Accordingly, the containment cylinder C depends by gravity to swing from the trunnions 17.

A feature is the eccentric position of the trunnions 17 axis with respect to the diameter of the receiver R whereby the receiver R also depends by gravity to have a top and a bottom. And in accordance with this invention, a target opening 20 is centrally located through the top of the receiver, an elongate opening more than adequate to simultaneously pass a plurality of marbles, preferably two marbles M. The target opening 20 is adapted to receive marbles M thrown from the wall 10 of the containment cylinder C.

From the foregoing it will be seen that the action toy hereinabove described is simple and its mode of operation easily understood. The marbles initially installed therein are captured and cannot be dispersed. The trunnions 17 project from the ends 11 so as to be grasped between the thumbs and index fingers of both hands, while the remaining fingers embrace the cylinder wall 10, to restrain and/or to cause rotation thereof in each instance. The toy T is held horizontally and tilted left or right so as to skillfully roll the marbles M into alignment with the target opening 20, whereupon containment cylinder C is moved forwardly so as to accellerate a selected marble M and simultaneously lifted so as to throw that marble upwardly. Additionally skill is then required to position the target opening 20 to catch that marble. Assuming that the wanted color of marble is received, it is left remaining in the receiver C to be collected. In the event that an unwanted color of marble is received, then the receiver can be revolved through the trunnions M so as to dump said marble, but with skill so that the wanted marble or marbles are not dumped. If by unskillfull movement or by accident the "scratch" marble is received at any time, that player's turn and score is voided. Various rules may be devised and followed.

Having described only a typical preferred form and application of my invention, I do not wish to be limited or restricted to the specific details herein set forth, but wish to reserve to myself any modifications or variations that may appear to those skilled in the art as set forth within the limits of the following claims.

I claim:

1. An action toy for the skillful collection of marbles contained therein, and including;

an elongated containment cylinder to be manually held and tipped end to end on its axis from a horizontal disposition and having a transparent cylinder wall for observation and with closed ends, an elongated receiver of tubular cross section for the collection of marbles and extending coextensively within the containment cylinder parallel to said axis thereof near to one side of the cylinder wall and having a transparent side wall, coaxial trunnions fixed to and extending from opposite ends of the receiver and rotatably projecting through coaxial bearing openings eccentrically positioned in the closed ends of the containment cylinder and exposed for turning by manipulation whereby both the containment cylinder and the receiver depend by gravity from said trunnions, a target opening through the said wall of the receiver intermediate the opposite ends thereof, and a multiplicity of marbles loosely captured within the containment cylinder and adapted to be selectively thrown by movements skillfully applied and caught by the receiver through said target opening and collected therein for observation and for subsequent dumping by turning said trunnions.

2. The action toy as set forth in claim 1, wherein the target opening through the top side wall of the receiver is of a width to simultaneously pass at least two marbles.

3. The action toy as set forth in claim 1, wherein the target opening through the side wall of the receiver is of a width to simultaneously pass at least two marbles, and wherein there are two distinguishable groups of marbles and at least one marble distinguishable from all others.

* * * * *